US006457462B2

(12) United States Patent
Morén

(10) Patent No.: US 6,457,462 B2
(45) Date of Patent: Oct. 1, 2002

(54) COMBINED CRANKCASE AND CANISTER VENTILATION SYSTEM

(75) Inventor: Mats Morén, Göteborg (SE)

(73) Assignee: Volvo Personvagnar AB (SE)

( * ) Notice: Subject to any disclaimer, the term of this patent is extended or adjusted under 35 U.S.C. 154(b) by 0 days.

(21) Appl. No.: 09/770,823

(22) Filed: Jan. 26, 2001

(30) Foreign Application Priority Data

Jan. 26, 2000 (SE) ..... 0000220

(51) Int. Cl.[7] ..... F02M 25/06
(52) U.S. Cl. ..... 123/572; 123/520; 123/573
(58) Field of Search ..... 123/572, 573, 123/574, 520

(56) References Cited

U.S. PATENT DOCUMENTS

| | | | | |
|---|---|---|---|---|
| 3,675,634 A | * | 7/1972 | Tatsutomi et al. | 123/572 |
| 4,630,575 A | * | 12/1986 | Hatamura et al. | 123/572 |
| 4,901,703 A | | 2/1990 | Humphries | |
| 5,205,265 A | * | 4/1993 | Kashiyama et al. | 123/572 |
| 5,499,616 A | * | 3/1996 | Enright | 123/572 |
| 5,564,401 A | * | 10/1996 | Dickson | 123/573 |
| 5,992,397 A | * | 11/1999 | Hideaki et al. | 123/538 |
| 6,123,061 A | * | 9/2000 | Baker et al. | 123/573 |

FOREIGN PATENT DOCUMENTS

| | | |
|---|---|---|
| DE | 19645665 A1 | 5/1998 |
| EP | 0860589 A1 | 8/1998 |

* cited by examiner

*Primary Examiner*—Marguerite McMahon
(74) *Attorney, Agent, or Firm*—Kilpatrick Stockton LLP

(57) ABSTRACT

A supercharged combustion engine including a cylinder block (1), a cylinder head (2) and a crankcase (3) containing oil, an induction air conduit (19, 21, 24) communicating with intake conduits (9) in the cylinder head. The induction air conduit is connected to a supercharging unit (23) and is provided with a throttle valve (26) downstream of the supercharging unit. A first evacuation conduit (40, 42) connects the crankcase, via a pressure regulator (45), to the induction air conduit (19) at a point downstream of the throttle valve for evacuation of blow-by gases from the crankcase. A second evacuation conduit (40, 43) connects the crankcase with the induction air conduit (24) at a point on the intake side of the supercharging unit. A device (29) for separating oil from the evacuated blow-by gas, at least one further evacuation conduit (46) connecting a collection container (47) or some other source of harmful emissions with the evacuation conduits and non-return valves (41, 44) in the first and second evacuation conduits (42, 43) prevent gases from flowing back into the crankcase.

18 Claims, 3 Drawing Sheets

COMBINED CRANKCASE AND CANISTER VENTILATION SYSTEM

CROSS REFERENCE TO RELATED APPLICATIONS

This application claims priority to Swedish Application No. 0000220-4, filed Jan. 26, 2000, which is expressly incorporated herein by reference.

TECHNICAL FIELD

The invention relates to a supercharged internal combustion engine having a cylinder block, a cylinder head, a crankcase containing oil and an air intake conduit. The air intake conduit communicates with air intake channels in the cylinder head, and which is connected to a supercharging unit and a throttle valve located downstream of the supercharging unit. A first evacuation conduit is provided that connects the crankcase and the air intake conduit via a pressure regulator at a point downstream of the throttle valve for evacuating gases, so called "blow-by", from the crankcase. A second evacuation conduit connects the crankcase to the air intake conduit at a point upstream of the supercharging unit. A device for separating oil from the evacuated blow-by gases is also provided. At least one further evacuation conduit is provided which can connect a collecting vessel, or another source of harmful emissions, with the evacuation conduits. Non-return valves are provided in the first and second evacuation conduits in order to prevent gases from flowing back into the crankcase.

BACKGROUND OF THE INVENTION

It is a known that it is not possible to achieve a piston ring seal, between a piston and a cylinder wall, which gives a complete sealing effect between a combustion chamber and a crankcase during normal operation of an internal combustion engine. A certain amount of combustion gases, hereinafter termed "blow-by", will, with few exceptions, flow past the piston rings into the crankcase of the engine. In order to avoid a high positive pressure in the crankcase, it must be ventilated, whereby the gases are removed leaving a low positive pressure, or a slight negative pressure in the crankcase.

Preferably, the crankcase is ventilated to atmospheric pressure, but for environmental reasons, it is not suitable to ventilate the gases directly to the surrounding atmosphere. In order to use the existing purification equipment of the engine, the blow-by must be returned to the combustion chamber, which is achieved by leading the gases into intake conduit(s) of the engine where the blow-by is mixed with the induction air. The simplest way of achieving this is to connect an evacuation conduit from the crankcase to the intake conduit at a point before the supercharging unit. At this point, between the intake air filter and the supercharging unit, the air pressure will be atmospheric, or near atmospheric. Although an oil separator of some form has traditionally been used, it has been inevitable that a certain amount of oil vapor has been included in the blow-by from the crankcase, through the evacuation conduit and into the supercharging unit. This oil vapor may condense and collect in the supercharging unit, and, depending on the amount of oil and the temperature, may disturb the function of the supercharging unit. In those cases where an intercooler is connected between the supercharging unit and the intake conduit, there is a risk of clogging the cooling channels causing a deterioration of the function of the intercooler.

The problem of oil collecting in the supercharging system can be avoided by connecting the evacuation after the throttle valve. There is often a significant negative pressure in this part of the conduit, however, especially at low engine load, which may cause an undesirable, very low negative pressure in the crankcase. In addition, it is not possible to evacuate the blow-by to this point of the conduit when the engine is being supercharged. One method for solving this problem, at least in part, is to use two evacuation conduits. One conduit is connected before the supercharging unit and one before the throttle valve. The latter is connected to the intake conduit via a throttling device, which limits the flow to the intake conduit, and a non-return valve which prevents flow in a direction away from said conduit. It is, however, difficult to achieve a balance in a system of this type, both for a normally aspirated engine, which has a negative pressure in the intake conduit at all times, and for a supercharged engine, which has a negative pressure in the intake conduit at low load and a positive pressure at high load. In one crankcase ventilation system for a supercharged engine, the evacuation conduit is connected to the intake conduit upstream of the supercharging unit and is provided with a pressure regulator arranged to maintain an almost constant pressure approximately equal to atmospheric pressure in the crankcase. At high load, gases will flow through the latter evacuation conduit to the suction side of the supercharging unit. Under this condition, there will be a positive pressure in the intake conduit, downstream of the throttle, causing the non-return valve in the other evacuation conduit to close and prevent air from flowing back into the crankcase. At low load and subsequent negative pressure downstream of the throttle valve, blow-by gases from the crankcase will flow via the non-return valve and the throttling device to the intake conduit. Under certain operating conditions, however, air may simultaneously be sucked from the intake conduit upstream of the supercharging unit, via the pressure regulator, to the intake conduit downstream of the throttle valve. Such an alternating flow of hot gases and cold air in opposite directions may result in condensation and a risk of freezing during cold weather conditions. One solution to this problem is to use a heating coil containing hot coolant around the evacuation conduit upstream of the throttle valve, although this adds to the cost of the system.

A similar problem occurs during evacuation of the vehicle canister. The canister is used for absorbing fuel vapor from the fuel tank in order to avoid ventilation of vapors to the atmosphere. Especially during filling of the tank, or during periods of high ambient temperatures, it is necessary for the canister to be able to absorb relatively large amounts of fuel vapor. The function of the canister itself is well known and will not be described here, in detail. In order to avoid saturation of the canister, it must be provided with an evacuation conduit, which, using negative pressure, sucks vapor from the canister, via a ventilating valve, to the induction system of the engine. A known solution is to split the evacuation conduit into two branches after the ventilating valve. A first conduit is connected downstream of the throttle valve and a second conduit is connected upstream of the supercharging unit, whereby each conduit is provided with a non-return valve.

Due to the degree of packing; i.e., the space used for assembly and installation of the engine and engine compartment components in relation to the available space, the introduction of new components and changes in the positioning of existing components is a problem. A new component can, for instance, be a system for purification of exhaust gases from the vehicle in front, whereby induction air, air for the passenger compartment and air passing through the engine compartment can be purified with respect to particles, nitrous oxides, etc. Such a system would require further conduits, and in certain cases, needs to be ventilated into the induction system of the engine.

SUMMARY OF THE INVENTION

The present invention, in its several disclosed embodiments, alleviates the drawbacks described above with respect to combined crankcase and canister ventilation systems and incorporates several additional beneficial features.

An object of the invention is to provide a supercharged combustion engine with pressure regulated crankcase ventilation, which eliminates the problems cited above. According to the invention, this is achieved by way of a combustion engine as described above, wherein the first and second evacuation conduits are connected in communication with a pressure regulator arranged to maintain a substantial constant pressure in the crankcase. Both evacuation conduits are provided with valves arranged to limit or prevent the flow of gases from the intake conduit to the crankcase. In addition, the system is provided with at least one further evacuation conduit, which can be used for ventilation of a collecting vessel of emissions, and the like, and is connected to the first and second conduits at a point between the pressure regulator and the valves.

According to the invention, pressure regulated crankcase ventilation is achieved both when the engine is normally aspirated (low load) and when it is supercharged (high load). During normally aspirated operation, virtually all blow-by will pass through the first evacuation conduit to the intake conduit downstream of the throttle, as the valve(s) in the second evacuation conduit prevents or limits the flow of intake air in the opposite direction; i.e., to the crankcase. During supercharged operation, with a positive pressure in the intake conduit, virtually all blow-by instead passes through the second evacuation conduit to the intake conduit upstream of the supercharging unit, as the valve means in the first evacuation conduit prevents or limits the flow from the intake conduit towards the crankcase.

By interconnecting existing evacuation conduits with further evacuation conduits for other types of emissions; for example, from a canister for fuel tank vapors or a catalytic purification device for cleaning ambient air, the number of new conduits and the accompanying couplings for the connection of these may be reduced significantly. This will simplify the installation of conduits, reduce the number of possible sources of leakages, and have a positive effect on the degree of packing of the engine. This is particularly true regarding the intake manifold, where it is often difficult to find room for more than one connection. Further advantages are that the system gives a stable negative pressure in the crankcase, and that the system diagnostics will be reliable, since a leakage exceeding the normal flow in any of the conduits will cause the engine to stop during idling, due to the large influx to the intake conduit. The emissions may be supplied continuously to the evacuation conduits, or be collected in a container in some form, such as a canister or a regenerative catalytic converter, for subsequent intermittent ventilation. In the latter case, a regulated valve is often required in order to control to the flow to the evacuation conduit.

BRIEF DESCRIPTION OF THE DRAWINGS

The invention will now be described in greater detail in the following way, but for example only, and with reference to the attached drawings, in which.

DETAILED DESCRIPTION OF THE INVENTION

Figure 1:
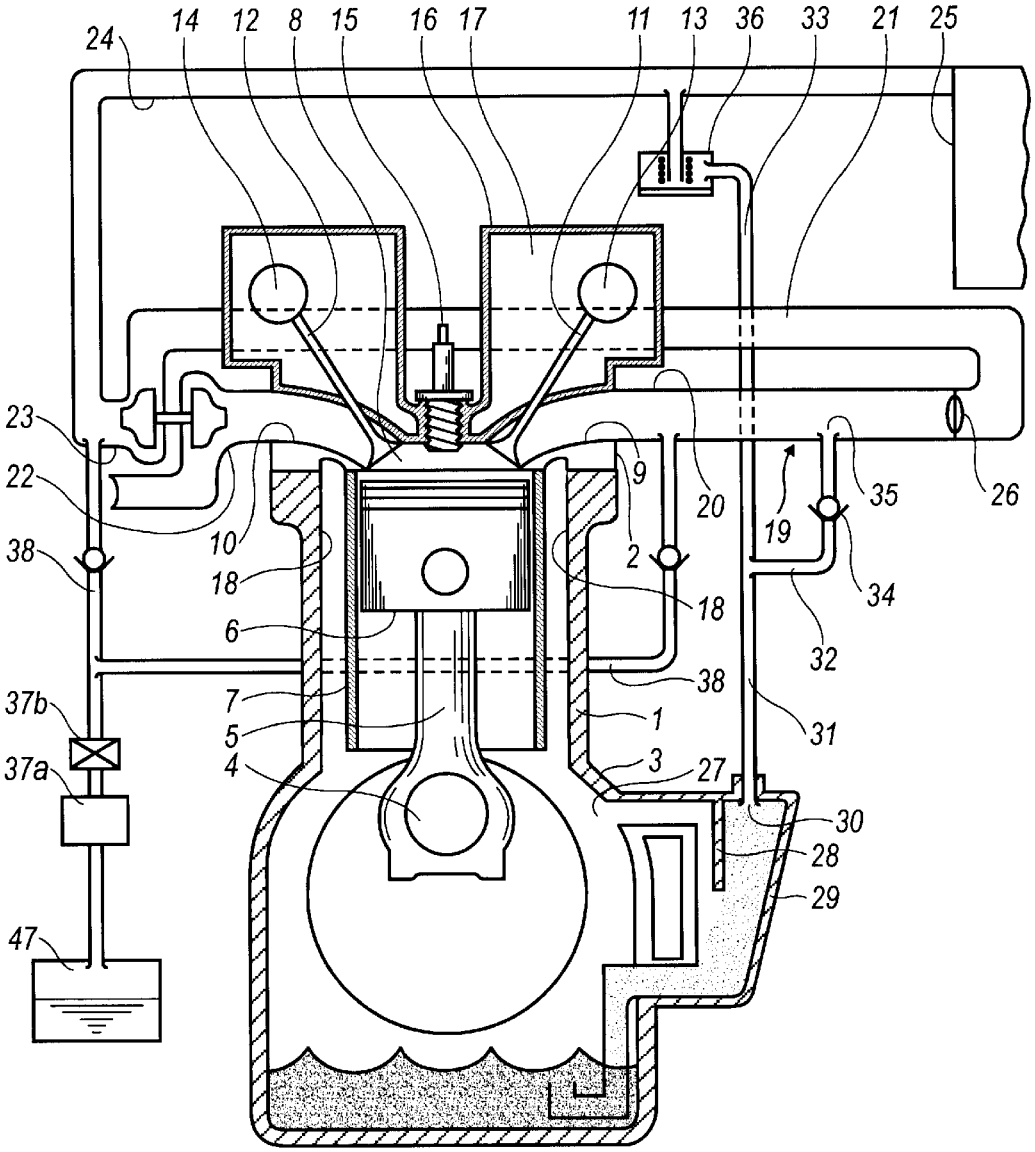
FIG. 1 ( PRIOR ART )
FIG. 1 shows a cross-section through one cylinder of a multi-cylinder in-line engine, wherein all evacuation conduits are connected to the intake conduit according to the state or the art.

As required, detailed embodiments of the present invention are disclosed herein. Referring tot he figures, a cross-section through one cylinder of a multi-cylinder (e.g. four or six cylinder) straight in-line engine is shown having a cylinder block 1, a cylinder head 2 and a crankcase 3 that contains oil. A crankshaft 4 is journalled in the crankcase and is connected to pistons 6 in cylinder bores 7 via connecting rods 5. Combustion chambers 8 are arranged in the cylinder head 2 and are provided with intake conduits 9 and exhaust conduits 10. The exchange of gases in the combustion chamber 8 is controlled by intake and exhaust valves 11 and 12 respectively, which are driven by camshafts 13 and 14, respectively. A spark plug 15 protrudes into each combustion chamber 8. Valves and camshafts are enclosed in a space 17, delimited by the cylinder head 2 and a cylinder head cover 16, which space communicates with the crankcase 3 via channels 18 in the cylinder head 2 and the engine block 1.

An intake manifold 19 is attached to the cylinder head 2 and is provided with branch conduits 20 which lead into the intake conduits 9 in the cylinder head. The manifold 19 is connected to the outlet side of a compressor 23 driven by an exhaust turbine 22, via a conduit including an intercooler (not shown). The inlet side of the compressor 23 is connected to an induction air conduit 24 that is provided with an air filter 25. The supply of air to the combustion chambers is controlled by a throttle valve 26. The crankcase 3 is provided with an opening 27 through which it communicates with a container 29. The container 29 is an oil separator provided with baffles 28 and is arranged to separate and return the oil in the oil mist which is inevitably drawn out through the opening 27 in the crankcase, together with the blow-by. The oil separator can constitute a state of the art plastic container attached to the outside of the crankcase or the cylinder head, or, alternatively, be integrated in the cylinder head.

A state of the art engine as shown in FIG. 1 that has an oil separator provided with an outlet 30 connected to a conduit 31. This conduit 31 is split into a pair of branch conduits 32 and 33, wherein the first conduit 32 is connected to the intake manifold 19 downstream of the throttle valve 26, and the second conduit 33 is connected to the induction air conduit 24 between the supercharging unit 23 and the air filter 25. The first branch conduit 32 communicates with the intake conduit 20 via a non-return valve 34 and a throttling device 35, while the second branch conduit 33 communicates with the induction air conduit 24 via a pressure regulator 36 arranged to maintain a substantially constant, just below atmospheric pressure, in the crankcase. At low load, when the engine operates as a normally aspirating engine with a negative pressure in the intake conduit 19 downstream of the throttle valve 26, the blow-by will flow mainly through the first conduit 32. This will result in no, or insignificant amounts of oil being collected downstream of the throttle valve 26. At high load when the engine is being supercharged to give a positive pressure in the intake conduit 19 downstream of the throttle valve 26, the non-return valve 34 will close so that the blow-by flows through the second conduit 33 to the induction air conduit 24. Due to high flow velocity, any oil mist is carried into the combustion chamber by the intake air without any oil sticking in the supercharging unit. Under certain operating conditions it is, as stated above, possible for cold intake air to be sucked from the induction air conduit 24, through the second branch conduit 33 and the pressure regulator 36, to the intake conduit downstream of the throttle valve 26. This alternating flow of hot blow-by gases and cold induction air in the second branch conduit 33 may cause freezing of the conduits in cold weather. For this reason, the conduit 33 is usually provided with some form of heater or other heating means. Additionally, the throttling device requires regular service in order to avoid clogging.

FIG. 1 also includes a schematic fuel tank 47 connected to a canister 37*a* for absorbing fuel vapor; the canister is fitted with a ventilation valve 37*b*. When ventilation of the canister 37*a* is required, the ventilation valve 37*b* is opened and the vapors are sucked out through an evacuation conduit by means of a negative pressure. The evacuation conduit splits into two branch conduits, of which a third conduit 38 is connected to the intake manifold 19 downstream of the throttle valve 26 and a fourth conduit 39 is connected to the induction air conduit 24 between the supercharger 23 and the air filter 25. Both conduits are provided with non-return valves to prevent flow in the opposite direction. Due to the degree of humidity in the fuel vapors, these conduits 38,39 may also experience problems with freezing and formation of ice, which must be taken into consideration when positioning the conduits. Alternatively, or as a complement, the conduits may be provided with heating coils or similar heating devices.

Figure 2:
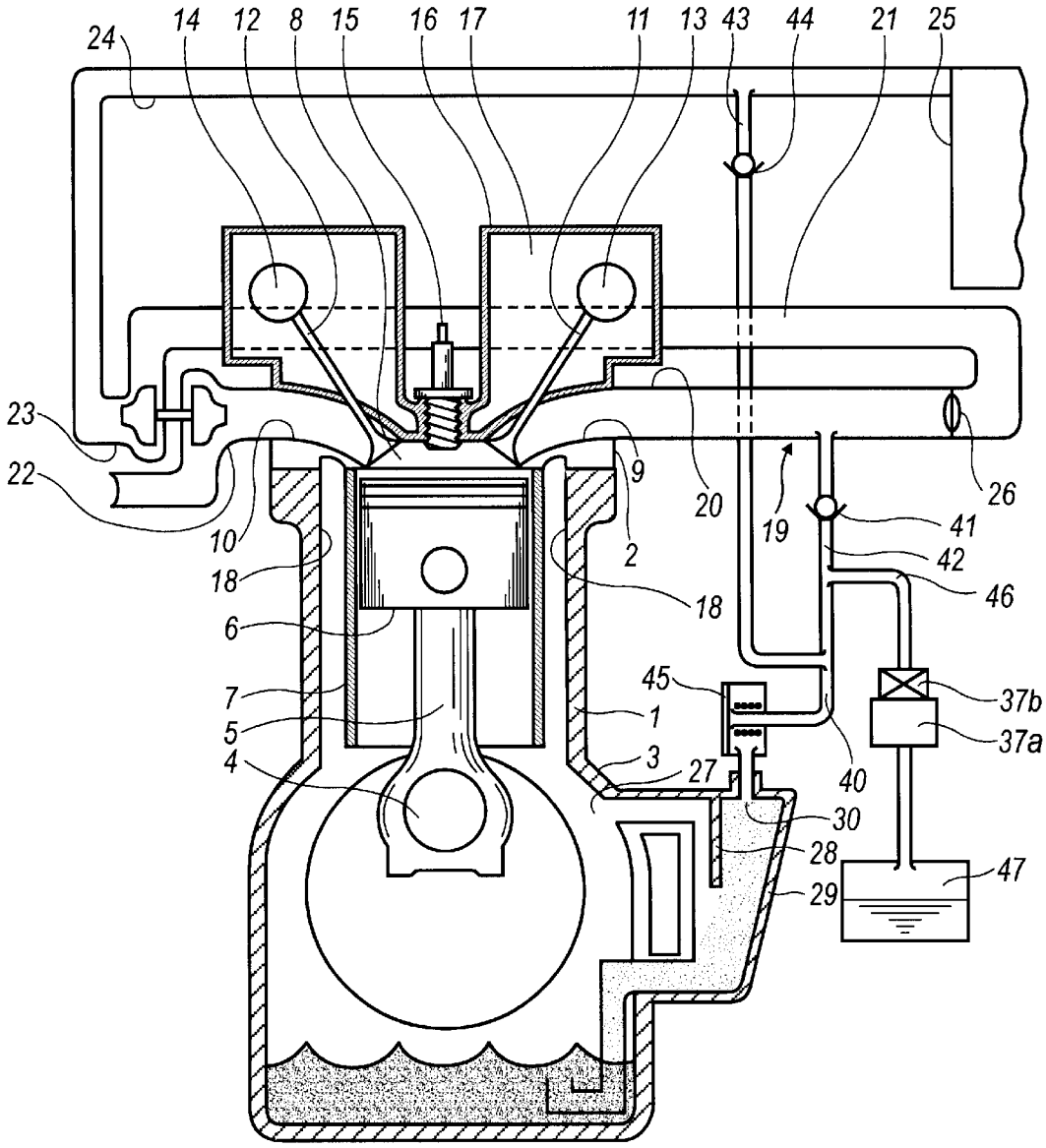
FIG. 2 shows a cross-section through one cylinder of a multi-cylinder in-line engine according to the invention, wherein multiple evacuation conduits are joined for connection to the intake conduit.
Figure 3:
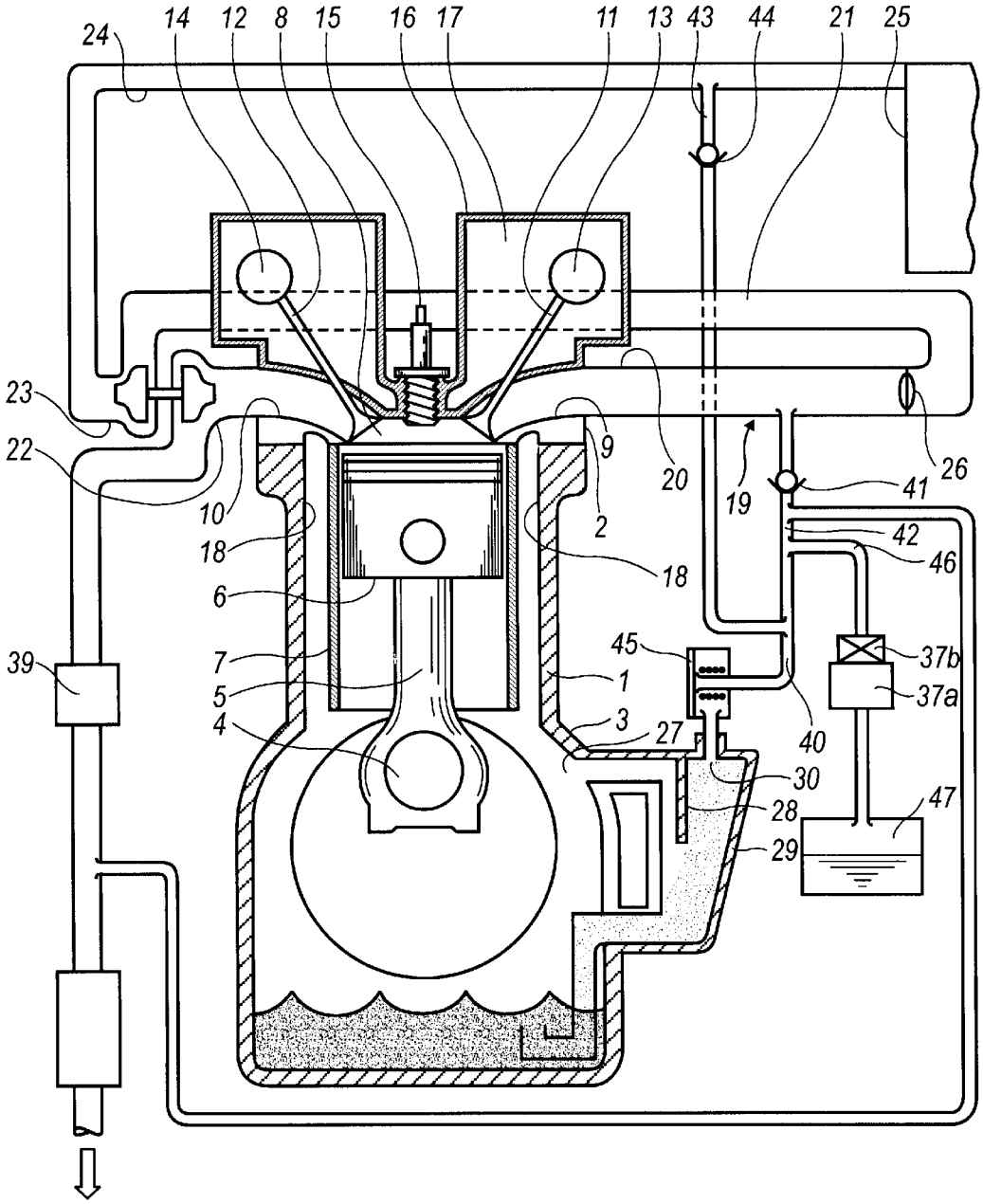
FIG. 3 shows an additional evacuation conduit.

FIG. 2 shows an arrangement configured according to the invention, which not only eliminates the above problems, but is also simple and inexpensive to install. The outlet 30 of the oil separator 29 exits directly into a pressure regulator 45 arranged to maintain a substantially constant pressure, just below atmospheric, in the crankcase 3. The pressure regulator 45 is connected to a conduit 40, which is split into two branch conduits 42,43. A first branch conduit 42 connects the pressure regulator 45 with the intake conduit 20 downstream of the throttle valve 26, and includes a non-return valve 41. A second branch conduit 43 communicates with the induction air conduit 24 at a point between the air filter 25 and the supercharging unit, and includes a non-return valve 44, which valve allows free flow of blow-by gas in the direction of the induction air conduit 24. The non-return valves 41,44 may be conventional valves, blocking flow in one direction only, or of the type which allows free flow in one direction and a limited flow in the other direction. The latter type is preferred since a limited flow in the conduit 43 from the suction side of the supercharging unit entails that any ice forming in the conduit during cold weather conditions will be evaporated through sublimation and carried into the combustion chamber. This is achieved by means of the flow and the low pressure present in the conduit. Hence it is possible to eliminate the formation of ice which theoretically can occur during a disturbance of the flow upstream of the supercharging unit.

One or more further evacuation conduits can be connected to the above conduits 40,42,43 preferably at a point between the pressure regulator 45 in the evacuation conduit 40 and the non-return valve 41 on the evacuation conduit 42. By connecting the vehicle canister 37*a* and its ventilation valve 37*b* with the evacuation conduit 40, fuel vapors will be sucked out the same route as the blow-by gases to be burnt in the engine. It is also advantageous to connect further branch conduits 46 near the non-return valve 41 for the evacuation conduit 42 leading to the intake conduit due to the time constant that determines the period of time required for the fuel vapors to reach the combustion chamber. The engine injection system must sense and adjust the amount of injected fuel since the maximum possible flow of vapor from the canister can be sufficient to maintain a vehicle speed of up to 50 km/h. It is also important to connect the branch conduit 42 to the intake manifold of the engine in such a way that the vapors are distributed evenly to all cylinders. This is not clear from FIG. 2, as it is a schematic representation.

Further examples of collection containers for emissions that can be ventilated by means of said evacuation conduit 40, is catalytic air purifiers used for cleaning ambient air. Many older vehicles lack a functioning catalytic exhaust treatment system, thereby emitting totally unpurified exhausts. A mobile catalytic air purifier carried on a vehicle may therefore trap many pollutants such as nitrous oxides ($NO_x$), ozone and particulate. During regeneration of the air purifier, these pollutants can be ventilated to the induction system of the engine for combustion so that they can be purified by the catalytic converter of the vehicle. In order to control the flow to the evacuation conduit, the system can be provided with a control valve (not shown), similar to the ventilation valve of the canister.

At low load, when the supercharging unit 23 is not in operation, there is a negative pressure in the intake conduit 20 downstream of the throttle valve 26, and blow-by gases will flow via the oil separator 29, the pressure regulator 45 and the conduits 40, 42 to the intake conduit. Note that the conduit 40 is not provided with a throttling device, corresponding to the device 35 in the known device of FIG. 1. This reduces the number of parts in the engine requiring service at regular intervals. At high load, when the compressor 23 is charging, there is a positive pressure in the intake conduit 20 and blow-by gases will flow via the oil separator 29, the pressure regulator 45 and the conduits 40, 43 to the induction air conduit 24. Gases and vapors from different collecting containers which have been connected to the evacuation conduit 42, via separate conduits 46, will thereby follow the same flow path as the blow-by gases.

What is claimed and desired to be secured by Letters Patent is as follows:

1. A supercharged combustion engine, the engine comprising:

a cylinder block, a cylinder head, a crankcase containing oil, an induction air conduit communicating with intake conduits in the cylinder head, the induction air conduit being connected to a supercharging unit and is provided with a throttle valve downstream of said supercharging unit, a first evacuation conduit connecting the crankcase with the induction air conduit at a point downstream of the throttle valve for evacuation of blow-by gases from the crankcase, a second evacuation conduit connecting the crankcase with the induction air conduit at a point on the intake side of the supercharging unit, wherein each evacuation conduit is provided with a valve arranged to limit or prevent the flow of gases from the induction air conduit towards the crankcase, a pressure regulator connecting the crankcase with said first and second evacuation conduits via a common conduit, said regulator being arranged to maintain a substantially constant pressure in the crankcase, and a device for separating oil from the evacuated blow-by gas, at least one further evacuation conduit arranged for ventilation of an emission source and being connected with said first and second evacuation conduits at a point between the pressure regulator and said valves, and additional evacuation conduits connected between the pressure regulator and the point where the common evacuation conduit branches into said first and second evacuation conduits.

2. The supercharged combustion engine according to claim 1 herein additional evacuation conduits are connected at the point where the common evacuation conduit, which is connected to the pressure regulator, branches into said first and second evacuation conduits.

3. The supercharged combustion engine according to claim 1 wherein said emission source is a collecting tank in the form of a canister connected to a fuel tank.

4. The supercharged combustion engine according to claim 1 wherein said at least one further evacuation conduit arranged for ventilation of an emission source further comprises a collecting tank having a catalytic air purifier for cleansing exhaust gases from the combustion chamber.

5. The supercharged combustion engine according to claim 1 wherein the valves are non-retum valves arranged to prevent flow from the induction air conduit to the crankcase.

6. The supercharged combustion engine according to claim 1 wherein the valves are non-retum valves arranged to allow a large flow from the crankcase to the induction air conduit and a limited flow in the opposite direction.

7. The supercharged combustion engine according to claim 1 wherein the device for separating oil from the evacuated blow-by gas is an oil separator to which the first evacuation conduit is connected.

8. A supercharged combustion engine, the engine comprising:

a cylinder block, a cylinder head, a crankcase containing oil, an induction air conduit communicating with intake conduits in the cylinder head, the induction air conduit being connected to a supercharging unit and is provided with a throttle valve downstream of said supercharging unit, a first evacuation conduit connecting the crankcase with the induction air conduit at a point downstream of the throttle valve for evacuation of blow-by gases from the crankcase, a second evacuation conduit connecting the crankcase with the induction air conduit at a point on the intake side of the supercharging unit, wherein each evacuation conduit is provided with a valve arranged to limit or prevent the flow of gases from the induction air conduit towards the crankcase, a pressure regulator connecting the crankcase with said first and second evacuation conduits via a common conduit, said regulator being arranged to maintain a substantially constant pressure in the crankcase, and a device for separating oil from the evacuated blow-by gas, at least one further evacuation conduit arranged for ventilation of an emission source and being connected with said first and second evacuation conduits at a point between the pressure regulator and said valves, and additional evacuation conduits connected at the point where the common evacuation conduit, which is connected to the pressure regulator, branches into said first and second evacuation conduits.

9. The supercharged combustion engine according to claim 8 wherein additional evacuation conduits are connected between the pressure regulator and the point where the common evacuation conduit branches into said first and second evacuation conduits.

10. A supercharged combustion engine comprising:

a cylinder block, a cylinder head and a crankcase containing oil;

an induction air conduit communicating with intake conduits in the cylinder head, said induction air conduit being connected to a supercharging unit and provided with a throttle valve downstream of said supercharging unit;

a first evacuation conduit connecting the crankcase with the induction air conduit at a point downstream of the throttle valve for evacuation of blow-by gases from the crankcase;

a second evacuation conduit connecting the crankcase with the induction air conduit at a point on an intake side of the supercharging unit;

a pressure regulator connecting the crankcase with said first and second evacuation conduits via a common conduit, said regulator being arranged to maintain a substantially constant pressure in the crankcase;

a separator configured to separate oil from the evacuated blow-by gas;

said evacuation conduit is provided with a valve arranged to limit or prevent the flow of gases from the induction air conduit towards the crankcase;

at least one additional evacuation conduit, arranged for ventilation of an emission source, is connected with said first and second evacuation conduits at a point between the pressure regulator and said valves; and an additional evacuation conduit connected between the pressure regulator and the point where the common evacuation conduit branches into said first and second evacuation conduits.

11. The supercharged combustion engine according to claim 10 further comprising:

an additional evacuation conduit connected at the point where the common evacuation conduit, which is connected to the pressure regulator, branches into said first and second evacuation conduits.

12. The supercharged combustion engine according to claim 10 wherein said emission source is a collecting tank in the form of a canister connected to a fuel tank.

13. The supercharged combustion engine according to claim 10 said at least one additional evacuation conduit further comprising:

a collecting tank in the form of a catalytic air purifier for cleansing exhaust gases from the combustion chamber.

14. The supercharged combustion engine according to claim 10 said valves being non-return valves arranged to prevent flow from the induction air conduit to the crankcase.

15. The supercharged combustion engine according to claim 10 said valves being non-return valves arranged to allow a large flow from the crankcase to the induction air conduit and a limited flow in an opposite direction.

16. The supercharged combustion engine according to claim 10 wherein said device for separating oil from the evacuated blow-by gas is an oil separator to which the first evacuation conduit is connected.

17. A supercharged combustion engine comprising:

a cylinder block, a cylinder head and a crankcase containing oil;

an induction air conduit communicating with intake conduits in the cylinder head, said induction air conduit being connected to a supercharging unit and provided with a throttle valve downstream of said supercharging unit;

a first evacuation conduit connecting the crankcase with the induction air conduit at a point downstream of the throttle valve for evacuation of blow-by gases from the crankcase;

a second evacuation conduit connecting the crankcase with the induction air conduit at a point on an intake side of the supercharging unit;

a pressure regulator connecting the crankcase with said first and second evacuation conduits via a common conduit, said regulator being arranged to maintain a substantially constant pressure in the crankcase;

a separator configured to separate oil from the evacuated blow-by gas;

said evacuation conduit is provided with a valve arranged to limit or prevent the flow of gases from the induction air conduit towards the crankcase;

at least one additional evacuation conduit, arranged for ventilation of an emission source, is connected with said first and second evacuation conduits at a point between the pressure regulator and said valves; and an additional evacuation conduit connected at the point where the common evacuation conduit, which is connected to the pressure regulator, branches into said first and second evacuation conduits.

18. The supercharged combustion engine according to claim 17 further comprising:

an additional evacuation conduit connected between the pressure regulator and the point where the common evacuation conduit branches into said first and second evacuation conduits.

* * * * *